US010189600B2

(12) United States Patent
Adams

(10) Patent No.: US 10,189,600 B2
(45) Date of Patent: Jan. 29, 2019

(54) PALLET-FREE BULK BIN CONTAINER

(71) Applicant: International Paper Company, Memphis, TN (US)

(72) Inventor: Wesley N. Adams, Elk Grove, CA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 137 days.

(21) Appl. No.: 15/282,252

(22) Filed: Sep. 30, 2016

(65) Prior Publication Data

US 2017/0096253 A1 Apr. 6, 2017

Related U.S. Application Data

(60) Provisional application No. 62/236,215, filed on Oct. 2, 2015.

(51) Int. Cl.
*B65D 13/00* (2006.01)
*B65D 19/20* (2006.01)

(52) U.S. Cl.
CPC .... *B65D 19/20* (2013.01); *B65D 2519/00019* (2013.01); *B65D 2519/00054* (2013.01); *B65D 2519/0087* (2013.01); *B65D 2519/00089* (2013.01); *B65D 2519/0091* (2013.01); *B65D 2519/00159* (2013.01); *B65D 2519/00194* (2013.01); *B65D 2519/00273* (2013.01); *B65D 2519/00293* (2013.01); *B65D 2519/00318* (2013.01); *B65D 2519/00333* (2013.01); *B65D 2519/00373* (2013.01); *B65D 2519/00497* (2013.01); *B65D 2519/00567* (2013.01); *B65D 2519/00597* (2013.01); *B65D 2519/00651* (2013.01); *B65D 2519/00711* (2013.01)

(58) Field of Classification Search
USPC ..... 206/386, 600, 598, 599
See application file for complete search history.

(56) References Cited

U.S. PATENT DOCUMENTS 2,902,199 A * 9/1959 Breton ..... B65D 19/20 108/55.1
4,119,205 A * 10/1978 Delany ..... B65D 19/20 108/56.3
4,863,024 A * 9/1989 Booth ..... B65D 19/0016 108/51.3
5,110,037 A * 5/1992 Pieritz, Sr. ..... B65D 5/68 206/386

(Continued)

FOREIGN PATENT DOCUMENTS

CS 228994 B1 2/1986
FR 2548139 A3 1/1985

(Continued)

*Primary Examiner* — Jacob K Ackun
(74) *Attorney, Agent, or Firm* — Thomas W. Ryan; Rebecca M. Greendyke

(57) ABSTRACT

A pallet-free bulk bin container comprises an open-ended bulk bin having a frame base at one end. A pair of channel inserts is configured to be engaged with the frame base to form pallet runners. A pair of center-filler supports is configured to enclose one end of the open-ended bulk bin. The bulk bin container may be shipped in a collapsed or knocked-down state and easily assembled into a larger container for use and being disassembled for re-use.

7 Claims, 6 Drawing Sheets

(56) References Cited

U.S. PATENT DOCUMENTS

| | | | | |
|---|---|---|---|---|
| 5,350,066 | A * | 9/1994 | Mendoza | B65D 19/20 108/51.3 |
| 5,537,937 | A * | 7/1996 | Juvik-Woods | B65D 19/0012 108/51.3 |
| 7,322,480 | B2 * | 1/2008 | Bragadeste | B65D 19/20 108/51.3 |
| 2006/0076255 | A1 | 4/2006 | Bragadeste et al. | |
| 2008/0179320 | A1 * | 7/2008 | Abel | B65D 19/20 220/1.5 |
| 2011/0308993 | A1 * | 12/2011 | Hill | B65D 19/20 206/600 |

FOREIGN PATENT DOCUMENTS

| | | | |
|---|---|---|---|
| GB | 1316090 | A | 5/1973 |
| JP | H0572730 | U | 10/1993 |
| JP | 2005014938 | A | 1/2005 |

* cited by examiner

PALLET-FREE BULK BIN CONTAINER

FIELD OF THE INVENTION

This invention relates to shipping containers, and more particularly to corrugated paperboard pallet-free bulk bin container that may be shipped in a collapsed or knocked-down state and easily assembled into a larger container for use and being disassembled for re-use.

BACKGROUND AND SUMMARY OF THE INVENTION

Corrugated paperboard containers are commonly used to store and transport a variety of goods. Many of these containers are quite large, holding from 500 to 2,000 pounds or more of product, and typically are placed on pallets so that the containers may be handled with forklifts or jack trucks and the like. Wooden pallets are used in most conventional systems. These pallets are strong but they also are relatively heavy and expensive and are difficult to transport or recycle after use. Moreover, containers that are stacked upon but not fastened to the pallet may become displaced during handling, thereby causing the forklift operator to waste valuable time in rearranging the containers on the pallet. In extreme cases, the containers may actually fall off the pallet, causing damage to or destruction of the goods being transported.

To avoid these problems, integrated container and pallet constructions have been developed in the prior art. In these constructions the bottom of the container is configured to have a pallet integrated into it, with outboard runners of the pallet extending along the outer side edges of the container, and openings inboard of the outboard runners for receiving the tines of a forklift. Conventional containers of this type usually are dimensioned to fit on a standard 40 inch by 48 inch pallet, and the tines of a forklift normally are set so that they extend through the openings inboard of the outermost runners. One problem with such containers is the ability to ship the containers in an unassembled or knock-down flattened condition, to reduce initial shipping costs due to its size, while providing the ability to set up such containers at the customer destination or other end user. Another problem is to store, destroy or otherwise handle wooden pallets.

Therefore, it would be desirable to have a bulk bin container that eliminates the need for a separate pallet and can be shipped in a knocked-down flattened condition or collapsed condition. Further, it would be desirable to have such a bulk bin container that can be easily and quickly set up at the user's facility and that could be knocked down or disassembled upon completion of the use.

Some of the advantages of the pallet-free bulk bin container of the present invention are as follows: the pallet-free bulk bin container is a complete bulk bin having a built-in corrugated pallet and an optional integrated lid. There is no need for wooden pallets or additional lid components. The knock-down flattened condition bulk bin folds from the knock-down position to the open position easily and quickly. The knock-down bulk bin is completely recyclable (when comprised of the standard corrugated components). The knock-down bulk bin can be stacked and stored efficiently in a warehouse when in the knock-down configuration. The knock-down position can also provide convenient and efficient returnable packaging for customers. The knock-down bulk bin can include various "kit" items i.e., bags, corner boards, partitions, and pads etc. depending on a customer's needs. The knock-down pallet-free bulk bin container can also be shipped internationally without having to meet lumber treatment codes as there is no wood in the design.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
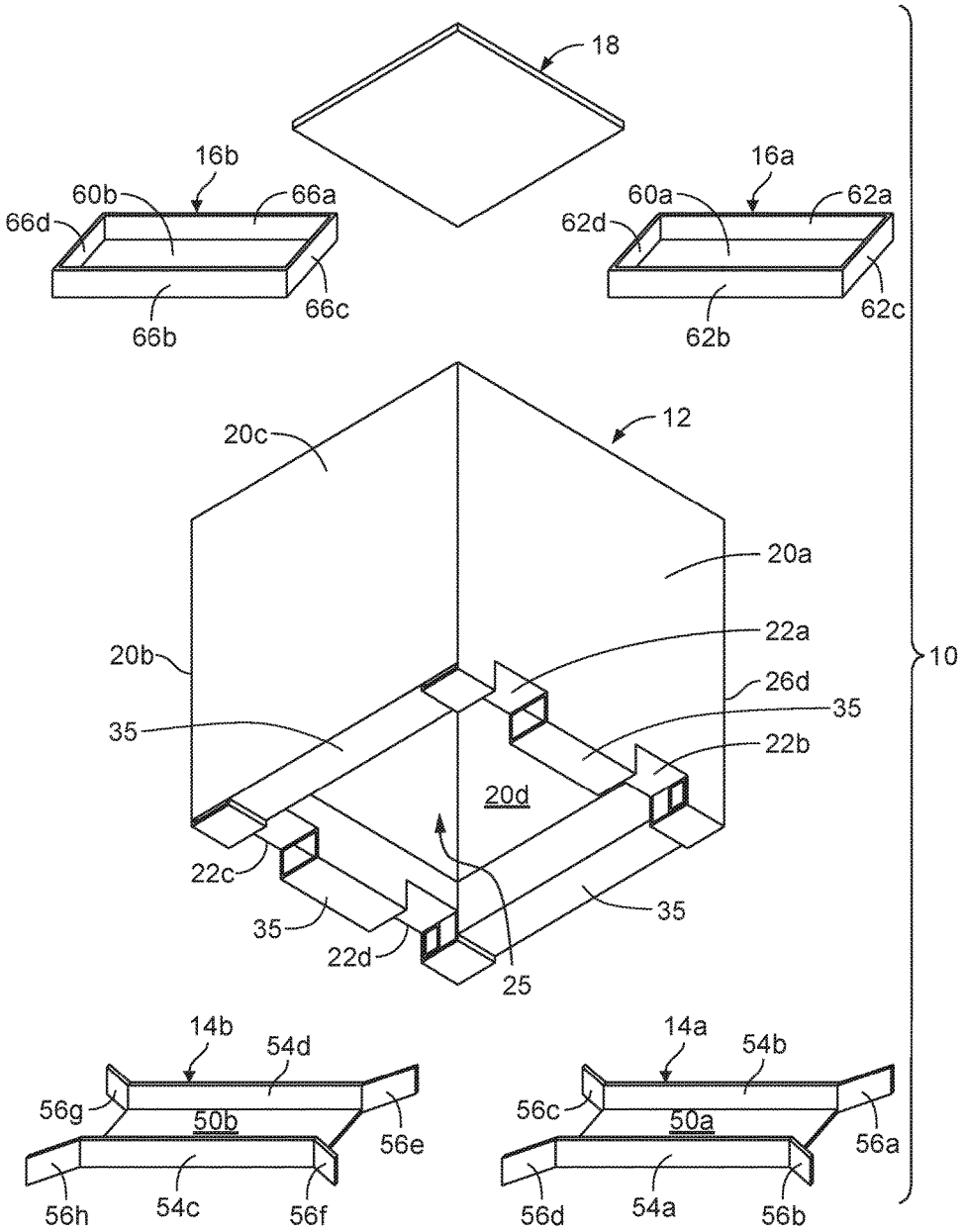
FIG. 1 is an exploded perspective view of the pallet-free bulk bin container having an open-ended bulk bin, a pair of channel inserts, a pair of center-filler supports, and a bottom pad in a spaced apart configuration in accordance to a preferred embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same.

Figure 2:
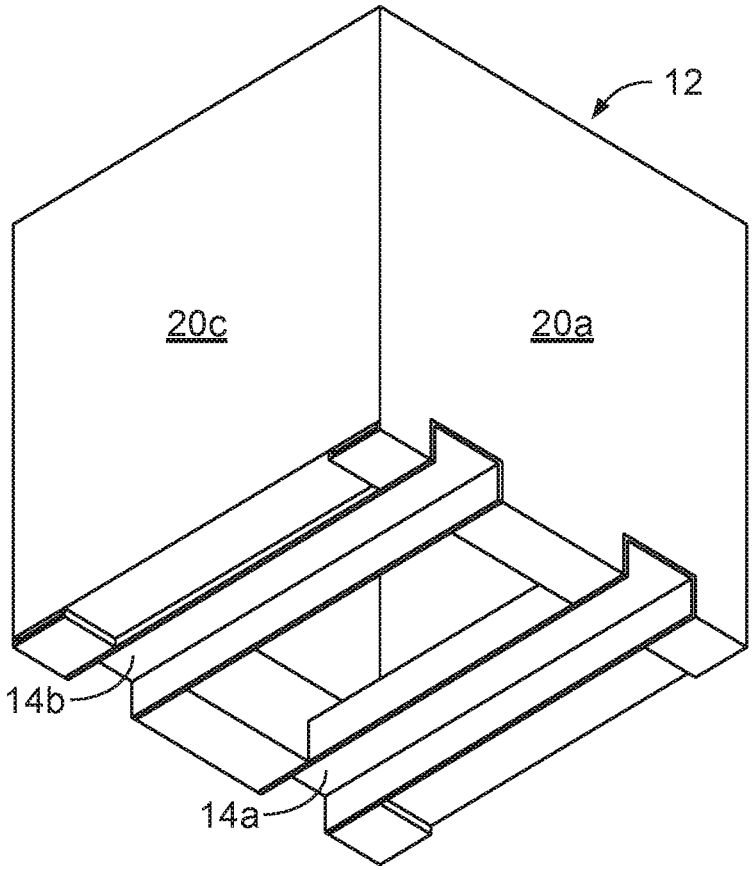
FIG. 2 is a bottom perspective view of the open-ended bulk bin in FIG. 1 illustrating the pair of channel inserts partially enclosing the bottom of the open-ended bulk bin.
Figure 3:
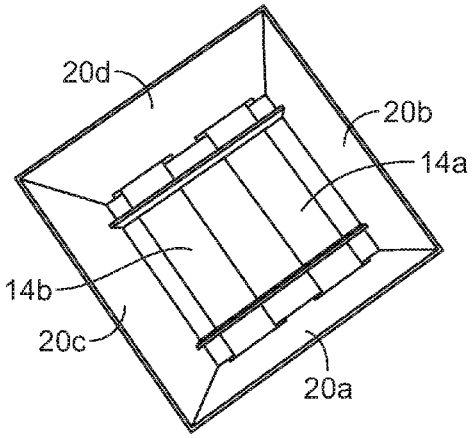
FIG. 3 is the same as FIG. 2 and depicting the top perspective view of the open-ended bulk bin with the partially enclosed bottom.
Figure 4:
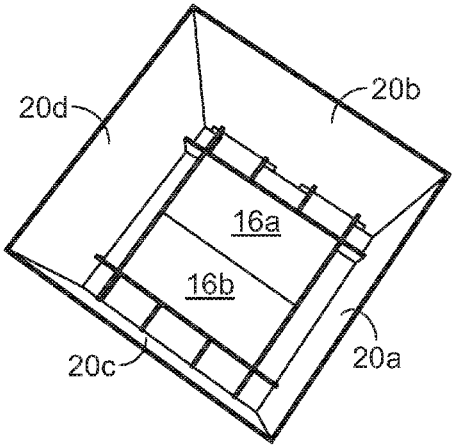
FIG. 4 is a top perspective view of the open-ended bulk bin in FIG. 3 illustrating the pair of center-filler supports fully enclosing the bottom of the open-ended bulk bin.
Figure 5:
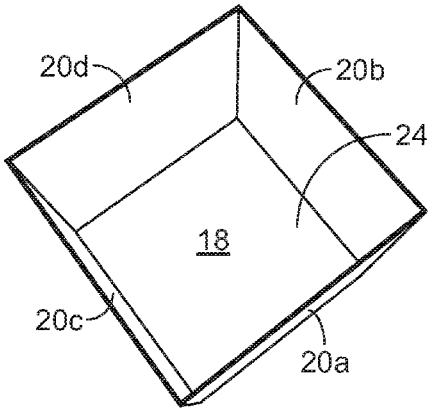
FIG. 5 is a top perspective view of the open-ended bulk bin in FIG. 4 illustrating the bottom pad positioned inside the open-ended bulk bin to receive products therein.
Figure 6:
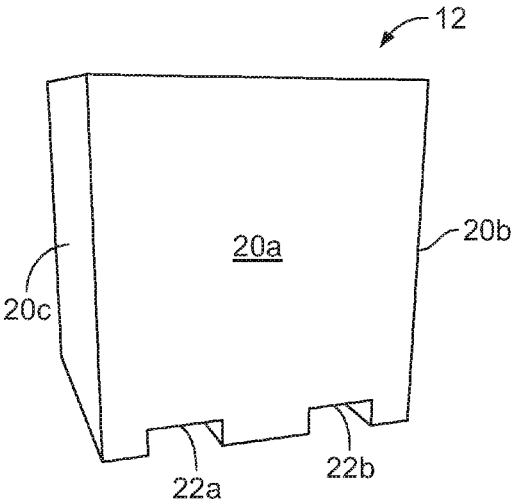
FIG. 6 is a perspective view of the fully assembled pallet-free bulk bin container as depicted in FIG. 1 in accordance to a preferred embodiment of the present invention.

FIG. 1 is an exploded perspective view of a pallet-free bulk bin container 10 having open-ended bulk bin 12, a pair of channel inserts 14*a*, 14*b*, a pair of center-filler supports 16*a*, 16*b*, and a bottom pad 18 all in spaced relationship with one another in accordance to a preferred embodiment of the invention. The open-ended bulk bin 12 includes four side walls 20*a*, 20*b*, 20*c*, and 20*d*. Each of the two side walls 20*a*, 20*b* includes a respective pair of fork access entry 22*a*, 22*b* and 22*c*, 22*d* formed by folding a plurality of inside and outside ledge panels that extend from respective bottom of the four side walls 20*a*, 20*h*, 20*c*, and 20*d* as will be discussed in greater detail hereinafter. The fork access entry 22*b* and 22*c*, 22*d* are generally rectangular in shape and spaced apart from one another. The pair of channel inserts 14*a*, 14*b* are each inserted into two of the fork access entries. For example, the channel insert 14*a* is attached to the fork access entries 22*a*, 22*c*, and the channel insert 14*b* is attached to the fork access entries 22*b*, and 22*d* as depicted best in FIG. 2. It should be noted that by attaching the respective channel inserts 14*a*, 14*b* to the respective fork access entries 22*a*, 22*b*, 22*c*, and 22*d*, a portion 25 that is open of a bottom of the open-ended bulk bin 12 is now partially enclosed as seen best in FIG. 3. Each of the pair of center-filler supports 16*a*, 16*b* is press fit or friction fit inside the open-ended bulk bin 12 to fully enclose the bottom of the open-ended bulk bin 12 as shown in FIG. 4. Finally, the bottom pad 18 is disposed inside the open-ended bulk bin 12 to provide support for the products received in the interior space 24 as shown in FIG. 5. The pallet-free bulk bin container 10 is sized sufficiently to contain articles therein for shipment and/or storage. Furthermore, the channel inserts 14*a*, 14*b*, and the center-filler supports 16*a*, 16*b* are respectively sized so that the bulk bin 12 can support the weight of the articles shipped and/or stored therein. However, one of ordinary skill in the art would appreciate that the claimed invention is not limited to two channel inserts or two center-filler supports since there can be one channel insert and one center-filler support for the purpose of the invention. The pallet-free bulk bin container 10 is adapted to be stacked on one or more of the same pallet-free bulk bin container 10.

Figure 7:
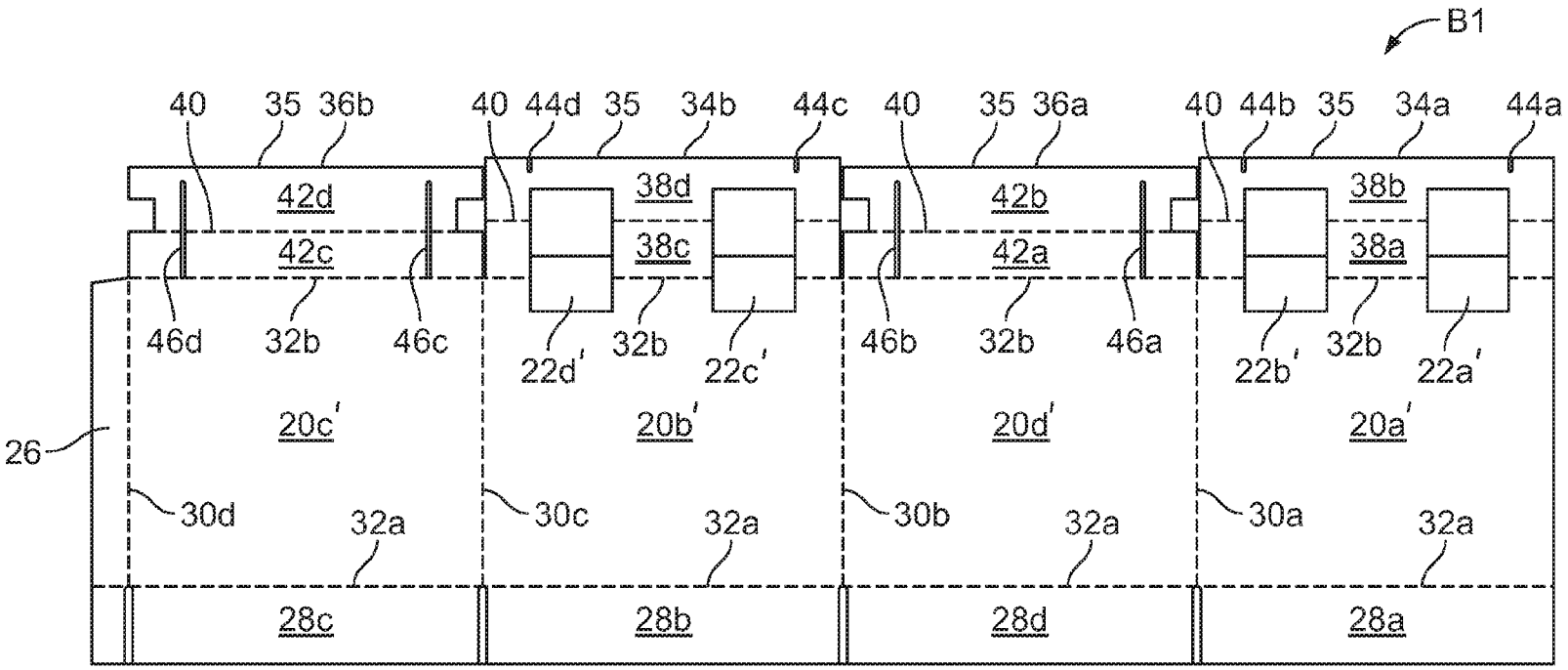
FIG. 7 is a top plan view of a blank B1 for making the open-ended bulk bin of the pallet-free bulk bin container.

FIG. 7 is a top plan view of a blank B1 for making the open-ended bulk bin 12 of the pallet-free bulk bin container 10. The blank B1 is substantially flat symmetrical with respect to its lateral axis and preferably is an integral piece of a material such as continuous sheet of conventional corrugated paperboard. The blank B1 is cut along its outer margins to form its specific shape. The blank B1 is foldably divided into four side wall panels 20*a*, 20*b*, 20*c*, and 20*d* by lateral fold lines 30*a*, 30*b*, 30*c*, and 30*d*. Four cover tuck flaps 28*a*, 28*b*, 28*c*, and 28*d* are formed on one longitudinal edge of the blank B1 by the longitudinal fold line 32*a*. Two outside ledge panels 34*a*, 34*b* and two inside ledge panels 36*a*, 36*b* are formed on other longitudinal edge of the blank B1 by fold line 32*b*. The respective outside ledges 34*a*, 34*b* are formed on one lateral end of the respective side wall panels 20*a* and 20*b* and the respective inside ledges 36*a*, 36*b* are formed on one lateral end of the respective side wall panels 20*c* and 20*d*. The respective outside ledges 34*a*, 34*b* and the inside ledges 36*a*, 36*b* are foldably attached to one another to form a frame base 35 so that the pair of channel inserts 14*a*, 14*b*, and the pair of center-filler supports 16*a*, 16*b* can be foldably attached thereto to enclose the bottom of the open-ended bulk bin 12 when the blank B1 is constructed. The frame base 35 functions as pallet runners which eliminates using a separate pallet for the bulk bin. The outside ledges 34*a* includes inner and outer panels 38*a*, 38*b* foldably joined to one another by fold line 40. Similarly, outside ledges 34*b* includes inner and outer panels 38*c*, 38*d* foldably joined to one another by fold line 40. Each of the respective outside ledges 34*a* and 34*b* includes two identical cut outs 22*a*', 22*b*', 22*c*', and 22*d*' which forms the fork access entries when the blank B1 is fully constructed. Each of the respective free edges of the outside ledges 34*a* and 34*b* includes first slots 44*a*, 44*b* and 44*c*, 44*d* that are formed to engage with inside ledge panels 36*a*, 36*b*. Furthermore, the inside ledge panels 36*a* includes inner and outer panels 42*a*, 42*b* foldably joined to one another by fold line 40 and the inside ledge panels 36*b* includes inner and outer panels 42*c*, 42*d* foldably joined to one another by fold line 40. Each of the respective inside ledge panels 36*a*, 36*b* includes two identical second slots 46*a*, 46*b* and 46*c*, 46*d* that are formed to engage with the respective first slots 44*a*, 44*b* and 44*c*, 44*d* so that the inside and outside ledges are securely attached to one another to form the frame base 35 at noted hereinbefore. A glue flap 26 is used to connect opposed ends of the blank B1 to one another in an end-to-end relation.

The folding sequence of the blank B1 is easily accomplished. However, an ordinary person skilled in the art would appreciate that a folding machine may alternatively perform the forming operations. First, the both ends of the blank B1 are brought together and the glue flap 26 is used to connect opposed ends of the blank B1 to one another in an end-to-end relation. Next, the respective inside ledge panels 36*a*, 36*b* are folded inwardly with respect to fold lines 32*b* and 40 toward the interior space of the bulk bin and then the outside ledge panels 34*a* and 34*b* are also folded inwardly in a manner that the respective first slots 44*a*, 44*b* and 44*c*, 44*d* and second slots 46*a*, 46*b* and 46*c*, 46*d* are fully engaged with one another. When the inside ledge panels 36*a*, 36*b* and the outside ledge panels 34*a* and 34*b* are fully constructed, the frame base 35 functions as pallet runners which eliminates using a separate pallet for the bulk bin.

Figure 8:
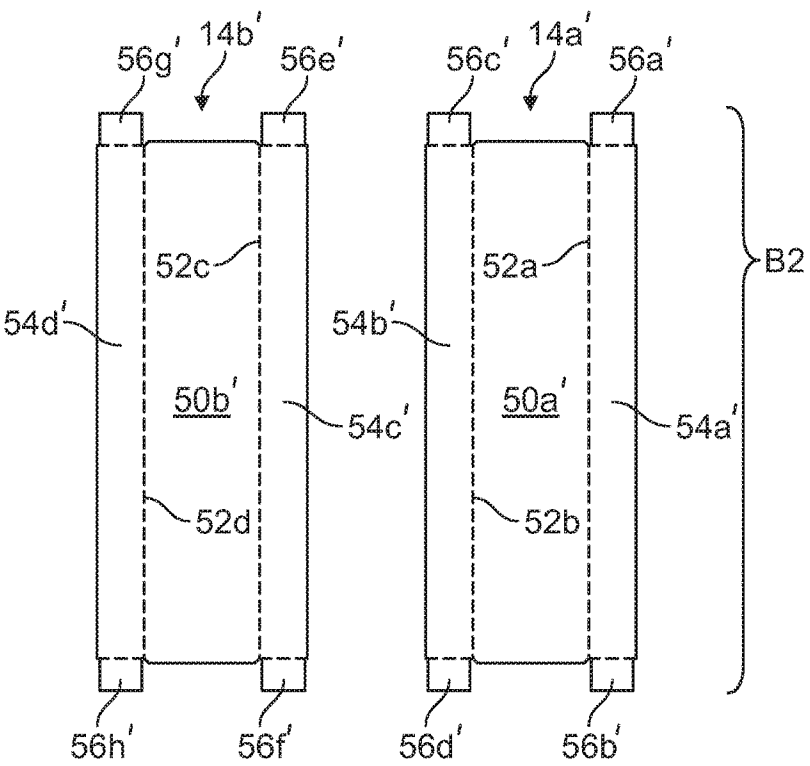
FIG. 8 is a top plan view of a blank B2 for making the pair of channel inserts used in the open-ended bulk bin to construct the pallet-free bulk bin container.

FIG. 8 is a top plan view of a blank B2 for making the pair of channel inserts 14*a*', 14*b*' used in the open-ended bulk bin 12 to construct the pallet-free bulk bin container 10. The blank B2 is substantially flat symmetrical with respect to its longitudinal axis and preferably is an integral piece of a material such as continuous sheet of conventional corrugated paperboard. The blank B2 is cut along its outer margins to form its specific shape of two identical channel inserts 14*a*' and 14*b*'. The channel insert panel 14*a*' is foldably divided into a central panel 50*a*' with two flaps 54*a*', 54*b*' each of which foldably extends from opposed longitudinal edges of the central panel 50*a*' via fold lines 52*a*, 52*b*. The central panel 50*a*' and the two flaps 54*a*', 54*b*' are generally rectangular shaped so that they correspond exactly to the shape of the fork access entries 22*b*, 22*d* of the bulk bin 12. Each of the respective flaps 54*a*' and 54*b*' includes two locking tabs 56*a*', 56*b*' and 56*c*', 56*d*' which they foldably extend from opposed lateral edges of each respective flap 54*a*' and 54*b*'. The channel insert panel 14*a*' is positioned inside one of the two fork access entries and is securely locked-in via the locking tabs 56*a*', 56*b*' and 56*c*', 56*d*' as seen best in FIGS. 1 and 2. Similarly, The channel insert panel 14*b*' is foldably divided into a central panel 50*b*' with two flaps 54*c*', 54*d*' each of which foldably extends from opposed longitudinal edges of the central panel 50*b*' via fold lines 52*c*, 52*d*. The central panel 50*b*' and the two flaps 54*c*', 54*d*' are generally rectangular shaped so that they correspond exactly to the shape of the fork access entries 22*a*, 22*c* of the bulk bin 12. Each of the respective flaps 54*c*' and 54*d*' includes two locking tabs 56*e*', 56*f*' and 56*g*', 56*h*' which they foldably extend from opposed lateral edges of each respective flap 54*c*' and 54*d*'. The channel insert panel 14*b*' is positioned inside one of the two fork access entries and is securely locked-in via the locking tabs 56*e*', 56*f*' and 56*g*', 56*h*' as seen best in FIGS. 1 and 2.

Figure 9:
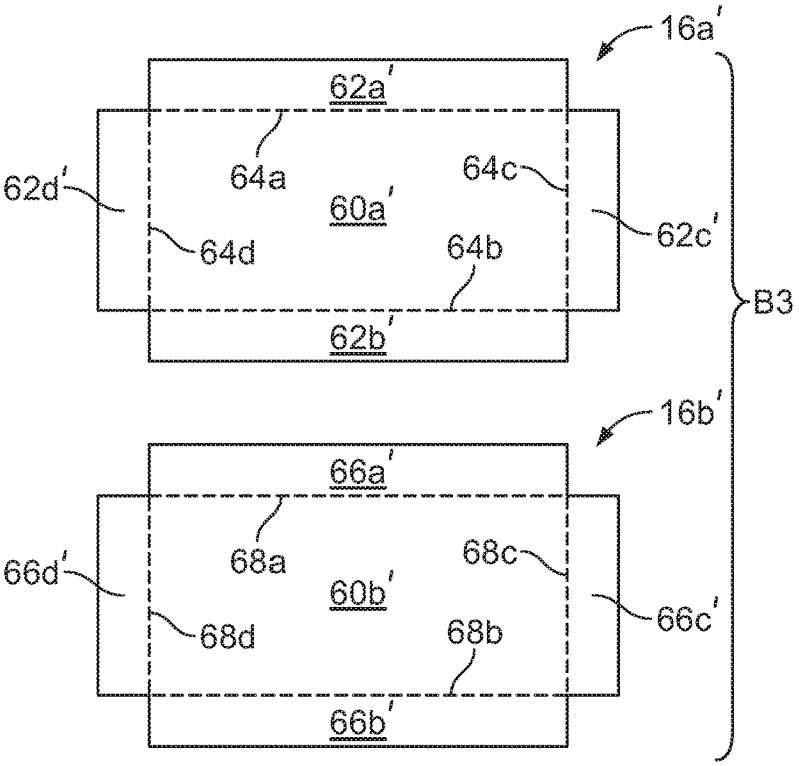
FIG. 9 is a top plan view of a blank B3 for making the pair of center-filler supports used in the open-ended bulk bin to construct the pallet-free bulk bin container.

FIG. 9 is a top plan view of a blank B3 for making the pair of center-filler supports 16*a*, 16*b* used in the open-ended bulk bin 12 to construct the pallet-free bulk bin container 10. The blank B3 is substantially flat symmetrical with respect to its longitudinal axis and preferably is an integral piece of a material such as continuous sheet of conventional corrugated paperboard. The blank B3 is cut along its outer margins to form its specific shape of two identical center-filler supports 16*a*' and 16*b*'. The center-filler supports 16*a*' is foldably divided into a central panel 60*a*' with four flaps 62*a*', 62*b*', 62*c*', and 62*d*' in which two flaps 62*a*', 62*b*' foldably extend from longitudinal edges thereof and two flaps 62*c*', 62*d*' foldably extend from lateral edges thereof via respective fold lines 64*a*, 64*b*, 64*c*, and 64*d*. In folding position, the central panel 60*a*' and the four flaps 62*a*', 62*b*', 62*c*', and 62*d*' forms a generally shallow rectangular tray that is used to cover the cavity inside interior space 24 as seen best with respect to FIGS. 3 and 4. Similarly, the center-filler supports 16*b*' is foldably divided into a central panel 60*b*' with four flaps 66*a*', 66*b*', 66*c*', and 66*d*' in which two flaps 66*a*', 66*b*' foldably extend from longitudinal edges thereof and two flaps 66*c*', 66*d*' foldably extend from lateral edges thereof via respective fold lines 68*a*, 68*b*, 68*c*, and 68*d*. In folding position, the central panel 60*b*' and the four flaps 66*a*', 66*b*', 66*c*', and 66*d*' forms a generally shallow rectangular tray that is used to cover the cavity inside the interior space 24 as seen best with respect to FIGS. 3 and 4.

Figure 10:
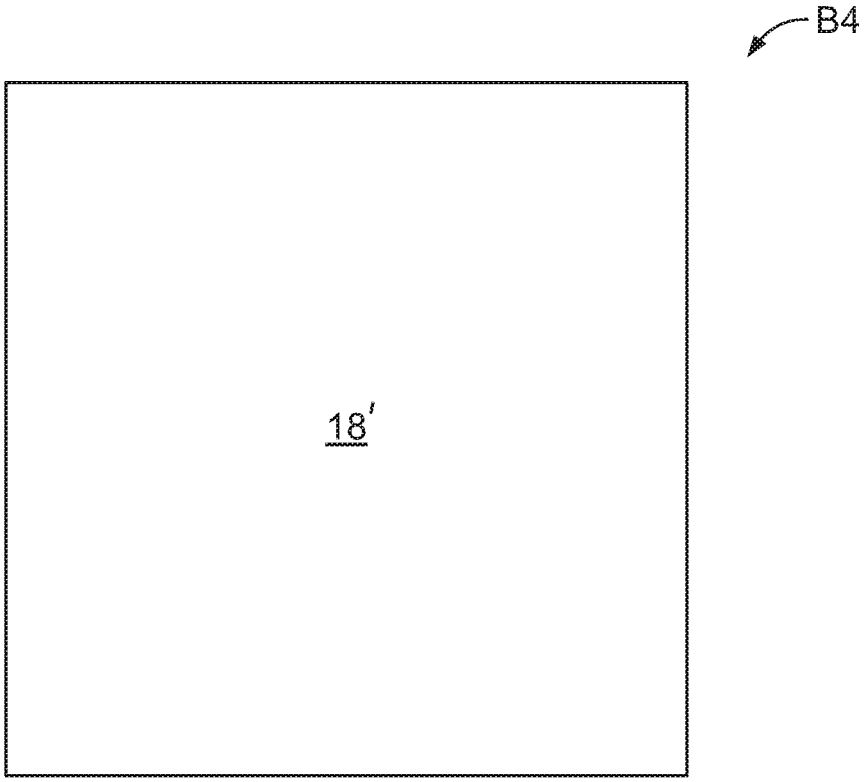
FIG. 10 is a top plan view of a blank B4 for making the bottom pad used in the open-ended bulk bin to construct the pallet-free bulk bin container.

FIG. 10 is a top plan view of a blank B4 for making the bottom pad panel 18' used in the open-ended bulk bin 12 to construct the pallet-free bulk bin container 10. The bottom pad panel is disposed in the bottom of the interior space 24 so that variety of products can be packaged therein.

In use, variety of bulk products are placed in the interior space 24 of the pallet-free bulk bin container 10 and a optional lid can be used to enclose the top-end of the bulk bin or alternatively, the pallet-free bulk bin container can be shrink-wrapped for shipment. For example, in a warehouse or retail store, the tines of a forklift are inserted into the fork access entries 22 so that the pallet-free bulk bin container can be lifted and moved around the warehouse.

The pallet-free bulk bin container 10 assembly of the present invention avoids the drawbacks of prior art knock down containers, including general structural weakness, loose fitting top cover and bulkiness of shipping. The inventive the pallet-free bulk bin container 10 assembly eliminates the need for a separate wooden or other pallet when transported and folds up or can be assembled rapidly without the use of tools. The knock down pallet-free bulk bin container 10 can be stacked and stored efficiently when in the knocked-down position. When in the knocked-down position, the pallet-free bulk bin container 10 provides a convenient and efficient returnable package for customers and is completely recyclable at the end of its effective use cycle. Unlike wooden pallets, the inventive pallet-free bulk bin container 10 can be shipped internationally without having to meet lumber treatment standards.

While the invention has been described and illustrated with reference to one or more preferred embodiments thereof, it is not the intention of the Applicants that the invention be restricted to such detail. Rather, it is the intention of the Applicants that the invention be defined by all equivalents, both suggested hereby and known to those of ordinary skill in the art, of the preferred embodiments.

What is claimed is:

1. A pallet-free bulk bin container assembly comprising:

an open-ended bulk bin having a frame base at one end, the one end comprising at least a portion that is open;

a pair of channel inserts configured to be engaged with the frame base to partially enclose the portion of the one end of the open-ended bulk bin that is open, the channel inserts being separate from the open-ended bulk bin; and a pair of center-filler supports received in the open-ended bulk bin to fully enclose the portion of the one end of the open-ended bulk bin that is open.

2. The pallet-free bulk bin container assembly of claim 1, further comprising a bottom pad disposed inside the open-ended bulk bin.

3. The pallet-free bulk bin container assembly of claim 1, wherein the frame base comprises a plurality of fork access entries formed therein to accommodate tines of a forklift or a pallet jack.

4. The pallet-free bulk bin container assembly of claim 1, wherein the container is constructed of paperboard.

5. The pallet-free bulk bin container assembly of claim 1, wherein the open-ended bulk bin comprises first, second, third, and fourth side walls, the first and second side walls comprising respective outside ledge panels foldably joined to a bottom end along a fold line and the third and fourth side walls comprising respective inside ledge panels foldably joined to a bottom end along a fold line, wherein the inside and outside ledge panels define the frame base and wherein the outside ledge panels each comprise two cut outs.

6. The pallet-free bulk bin container assembly of claim 1, wherein the channel inserts comprise a central panel, a pair of flaps foldably extending from opposed longitudinal edges of the central panel, and a pair of locking tabs foldably extending from opposed lateral edges of each respective flap.

7. The pallet-free bulk bin container assembly of claim 1, wherein the center-filler supports comprise a central panel, two flaps foldably extending from longitudinal edges of the central panel, and two flaps extending from lateral edges of the central panel.

* * * * *